US005183520A

United States Patent [19]

Wanninger et al.

[11] Patent Number: 5,183,520

[45] Date of Patent: Feb. 2, 1993

[54] EXPLOSIVE CHARGE

[75] Inventors: Paul Wanninger, Schrobenhausen; Richard Wild, Karlshuld; Ernst Kleinschmidt; Helmut Späth, both of Schrobenhausen, all of Fed. Rep. of Germany

[73] Assignee: Messerschmitt-Bölkow-Blohm GmbH, Munich, Fed. Rep. of Germany

[21] Appl. No.: 665,404

[22] Filed: Mar. 5, 1991

[30] Foreign Application Priority Data

Mar. 6, 1990 [DE] Fed. Rep. of Germany ..... 4006961

[51] Int. Cl.[5] ..... C06B 45/10

[52] U.S. Cl. ..... 149/19.91

[58] Field of Search ..... 149/19.91

[56] References Cited

U.S. PATENT DOCUMENTS

| | | | |
|---|---|---|---|
| 3,723,204 | 3/1973 | Evans et al. | 149/19.91 |
| 4,090,894 | 5/1978 | Reed et al. | 149/19.91 |
| 4,445,948 | 5/1984 | Stanton et al. | 149/19.91 |
| 4,985,094 | 1/1991 | Nahlovsky et al. | 149/19.9 |
| 5,009,728 | 4/1991 | Chan et al. | 149/19.91 |
| 5,071,499 | 12/1991 | Torres | 149/109.4 |

*Primary Examiner*—Edward A. Miller
*Attorney, Agent, or Firm*—McGlew and Tuttle

[57] ABSTRACT

A pressed explosive charge with high performance capacity and low sensitivity has a plastic binder with a Shore A hardness of less than 20.

1 Claim, 1 Drawing Sheet

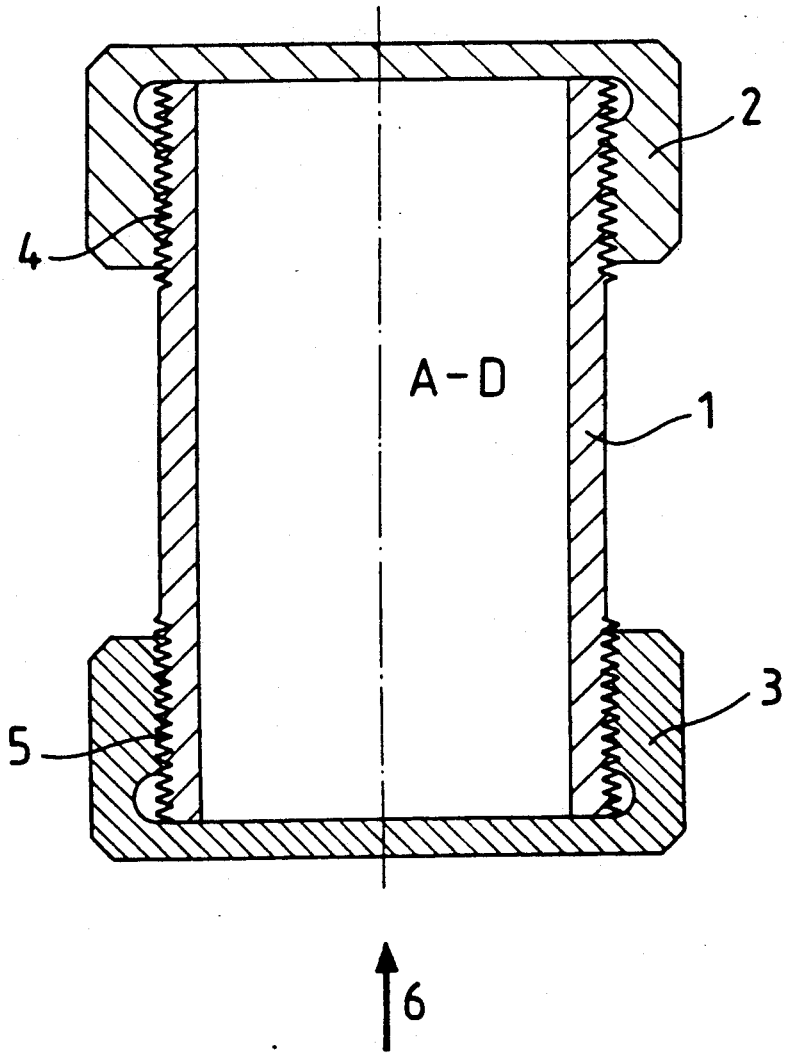
2
4
A-D
1
3
5
6

EXPLOSIVE CHARGE

FIELD OF THE INVENTION

The present invention pertains to a pressed, plastic-bonded explosive charge. It also pertains to an explcsive/plastic binder granular product for producing such an explosive charge.

BACKGROUND OF THE INVENTION

The pressing of explosive charges by means of hydraulic presses under high pressures of up tc 1000 bar and higher represents the most important process for manufacturing high performance explosive charges, besides casting However, while plastic-bonded explosive charges produced by casting contain only at most 90 wt. % explosive, a higher percentage of explosive, equaling 95 wt. % or higher, can be reached in the case of pressed plastic-bonded explosive charges.

In plastic-bonded explosive charges, thermoplastics or curable plastics, in which the crystalline explosive particles are embedded, are used as the binder for the crystalline explosive. The charge is then produced from the granular explosive and plastic by pressing.

Due to the above-mentioned high percentage of explosive and the use of high explosives, such as Octogen, pressed, plastic-bonded explosive charges have a high energy content. Therefore, they are used mainly for hollow charges and similar high performance charges.

The commercially available explosive/plastic binder granular products for producing pressed charges contain especially polyurethanes as well as fluoropolymers as the plastic binder. Thus, a granular product containing a hexafluoropropylene-vinylidene fluoride polymer known under the trademark "VITON A" and another granular product with a thermoplastic polyurethane binder under the trademark "ESTANE" as the plastic binder are commercially available.

However, at high percentages of Octogen of 95 wt. % or more, the pressed explosive charges produced from these granular products are extremely sensitive and therefore do not meet the requirements imposed in terms of the safety of ammunition, e.g., against bullet impact and fire.

SUMMARY AND OBJECTS OF THE INVENTION

It is an object of the present invention to provide a pressed, plastic-bonded explosive charge which meets all the safety requirements, without any reduction of performance.

This is achieved according to the present invention by using a plastic binder which has a Shore A hardness below 20 and preferably below 10 and especially preferably below 5 wt. % at room temperature in the cured, i.e., stable final state.

For example, "VITON A" has a Shore A hardness of 70, and even the softest plastic binders used so far for plastic-bonded pressed charged still have a Shore A hardness exceeding 40. This also applies to other inert binders as plastics, i.e., for example, to wax binders, which also have a considerable hardness at room temperature.

Consequently, the plastic binder used according to the present invention is extremely soft, and preferably soft enough to form a gel. The gel has a penetration greater than 5 mm/10, and preferably greater than 100 mm/10, and especially preferably greater than 200 mm/10 according to DIN ISO 2137 (with a 150-g hollow cone).

The explosive charge according to the present invention or the explosive/plastic binder granular product used to produce it contains more than 90 wt. %, preferably more than 95 wt. %, and especially preferably more than 97 wt. % explosive, i.e., the percentage of plastic binder is less than 10 wt. %, preferably less than 5 wt. %, and especially preferably less than 3 wt. %.

Consequently, all high explosives, e.g., Nitropenta, NTO (3-nitro-1,2,4- triazol-5-one), hexanitrostilbene, or triaminotrinitrobenzene, can be used as explosives according to the present invention, besides Octogen.

The charge according to the present invention has a modulus of elasticity of preferably less than 300 $N/mm^2$ and especially preferably less than 200 N/mm, as well as a compressive strength of preferably less than 5 $N/mm^2$.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The sole drawing shows a sectional view of a steel case.

DETAILED DESCRIPTION OF THE INVENTION

The extraordinarily high softness of the plastic binder used according to the present invention can be reached with a high plasticizer content. The amount of plasticizer is at least 20 wt. % and preferably at least 40 wt. % relative to the plastic-plasticizer mixture, but the percentage of plasticizer should not exceed 80 wt. % and preferably 60 wt. %.

For example, dicarboxylic acid esters, such as di-2-ethylhexyl adipate (DOA), are suitable as plasticizers. Any polymer, especially a thermoplastic, which can be plasticized by a plasticizer to the extent that it will have a Shore A hardness below 20 or below 10 may be used as the plastic. EVA (ethylene-vinyl acetate polymer), which, mixed with, e.g., 40 to 60 wt. % DOA, has a Shore A hardness below 4, has proved to be particularly suitable.

Together with the plasticizer, the polymer is dissolved in a solvent and mixed with the crystalline explosive. After drawing off the solvent, a pressable granular prcduct consisting of explosive embedded in plastic is left.

Besides a thermoplastic, the plastic of the explosive charge according to the present invention may also be a plastic that can be cured by, e.g., polymerization, pclycondensation, or polyaddition, or crosslinking. In this case, the explosive is mixed with the noncured plastic, and the plastic is cured.

A silicone rubber, which can be crosslinked by addition at room temperature, has proved to be particularly suitable as a plastic binder; this plastic binder is commercially available and forms (in the stable final state) a very soft, gel-like vulcanizate with a penetration of ca. 300 mm/10 (DIN ISO 2137, 150-g hollow cone).

The explosive/plastic binder granular product according to the present invention can be pressed by means of a hydraulic press under a pressure of 1000 bar or higher into an explosive charge, whose density preferably exceeds 92% and especially preferably 98% of the theoretical maximum density, i.e., it has a pore volume of preferably less than 8 vol. % and especially preferably less than 2 vol. %.

The present invention will be explained in greater detail by the following examples.

EXAMPLE 1

200 g eachof the components A and B of the silicone gel binder and 6 L toluene are charged into a 25-L planetary mixer. After adding 9.6 kg Octogen (particle size 5 to 600 microns), the mixture is homogenized. Most of the toluene is removed from the homogeneous mass at 60°-80° C. under 10-20 mbar. The remaining Octogen/plastic binder granular product is dried at 100° C. within 2 hours.

EXAMPLE 2

200 g each of EVA and DOA are dissolved in 6 L toluene. Together with 9.6 kg Octogen (particle size 5 to 600 microns), the solution is homogenized in a 25-L planetary mixer. Most of the toluene is removed from the homogeneous mass at 60°-80° C. under 10-20 mbar. The remaining Octogen/plastic binder granular product is dried at 80° C. in 12 hours.

Using a hydraulic press, pressed charges A and B were produced from the Octogen/plastic binder mixtures according to the Examples 1 and 2, both of which contain 96 wt. % Octogen.

For comparison, an Octogen/plastic binder granular product was produced from the same Octogen of the same particle size as in Examples 1 and 2 and with the same percentage of Octogen of 96 wt. %, but "Viton A" (hexafluoropropylene-vinylidene fluoride (1: 2) polymer) or pure EVA (i.e., without plasticizer) was used as the plastic binder. Pressed charges C ("Viton A") and D (EVA) were produced from these materials under the same conditions as in the case of the granular products according to Examples 1 and 2.

The properties of the plastic binders used for the charges A through D are shown in Table I below, and the strength characteristics of the charges A through D pressed with these plastic binders are shown in Table II.

TABLE I

| Plastic binder | Hardness (Shore A) | Penetration (mm/10) |
|---|---|---|
| Silicon gel vulcanizate (Example 1) | — | 300 |
| EVA/DOA (Example 2) | 2 to 3 | — |
| "Viton A" (Comparison) | 70 | — |
| EVA (Comparison) | 35 | — |

TABLE II

| | Modulus of elasticity ($N/mm^2$) | Compressive strength ($N/mm^2$) |
|---|---|---|
| Charge A | 150 | 2 |
| present invention | | |
| Charge B | 130 | 2.5 |
| Charge C | 550 | 10 |

TABLE II-continued

| | Modulus of elasticity ($N/mm^2$) | Compressive strength ($N/mm^2$) |
|---|---|---|
| Comparison | | |
| Charge D | 380 | 8 |

One charge A through D each was introduced into a steel case, whose cross section is shown in the drawing and consists of a cylindrical steel shell 1 with an internal diameter of 50 mm and has a wall thickness of 5 mm, onto which steel closing cap 52 and 3 with an internal thread 4 and 5 are screwed on both sides.

The firing boxes containing the charge A through D were then fired on with 12.7-mm hard core ammunition in the direction of arrow 6 according to the STANAG Specifications No. 4241 "Bullet Attack Test For Munitions" of May 9, 1988.

Furthermore, the pressed charges A through D were subjected to the so-called "Fast Cook-Off" test according to STANAG Specification No. 4240 of "Liquid Fuel Fire Tests For Munitions" of May 9, 1988. To do so, the charges A through D were tamped into firing boxes according to the drawing and heated at a rate of approximately 3 K/sec until the explosive charge reacted. The violence of the reaction and consequently the sensitivity of the explosive charge are inferred from the appearance of the charges A through D or of the shell 1 after the event, i.e., after the bullet impact or the reaction of the explosive charge.

Based on the appearance of shell 1 or the explosive charge, the following types of reaction are distinguished:

RT 0 =shell fully intact, only bullet hole in the explosive charge,

RT 1 =shell fully intact, cracks in the explosive charge,

RT 2 =shell fully intact, explosive charge burned out, RT 3 =shell bulged but not burst, RT 4 =shell burst into two or mcre large parts, RT 5 =shell broken into many small slivers. The results obtained with the charges A through D in the bullet attack test and the "Fast Cook-Off" test are shown in Table III below.

TABLE III

| | Bullet fire (type of reaction) | Cook-Off (Type of reaction) |
|---|---|---|
| Charge A | 0 | 2 |
| Present invention | | |
| Charge B | 1 | 2 |
| Charge C | 5 | 5 |
| Comparison | | |
| Charge D | 5 | 5 |

As is apparent from Table III, the charges A and B according to the present invention are practically fully insensitive to bullet impact (RT 0 and RT 1, respectively), and only burning out of the charges takes place in the "Fast Cook-Off" test as well, while the shell remains fully intact (RT 2). In contrast, the reference charges C and D burst into small slivers (RT 5) in both the bullet attack test and the "Fast Cook-Off" test.

Besides the bullet attack with hard core ammunition, the charges A and B were also fired on in the firing box according to the present invention with a small hollow charge (caliber 25 mm), from a distance corresponding to 3 times the caliber. Only the reaction types 0 through 1 were observed.

To check the performance capacity of the charge according to the present invention, explosions were carried out with standard hollow charges with a caliber of 96 mm, which were produced from the Octogen/-plastic binder granular product according to Example 1. The depth of penetration of the hollow charge spike of this hollow charge into a steel block was evaluated as the performance criterion. At a distance of 768 mm (caliber 8 HL) between the hollow charge and the steel block, depths of penetration of between 900 and 1000 mm into the steel block were measured. This corresponds to the results obtained with pressed hollow charges which were produced from the commercially available Octogen/plastic binder granular products PBX N5 (with "Viton A" as the plastic binder) and LX 14 (with "Estane" as the plastic binder), or with a cast hollow charge made from Octol (Octogen/TNT 85/15). Consequently, despite its low sensitivity, the explosive charge according to the present invention has a performance level comparable to that of the prior-art high-performance explosive charges.

While a specific embodiment of the invention has been shown and described in detail to illustrate the application of the principles of the invention, it will be understood that the invention may be embodied otherwise without departing from such principles.

What is claimed is:

1. An explosive charge, comprising a pressed plastic bonded explosive charge pressed to provide a density greater than 92% of a theoretical maximum density, said pressed plastic bonded explosive charge including a plastic binder forming 5–2 wt. % of said pressed plastic bonded explosive charge, said binder having a 1:1 mixture of di-2-ethylhexyl adipate (DOA) and ethylene-vinyl-acetate polymer (EVA) and including an explosive charge component of 95–98 wt. %.

* * * * *